US005765992A

United States Patent [19]

Muramatsu et al.

[11] Patent Number: 5,765,992

[45] Date of Patent: Jun. 16, 1998

[54] REGENERATIVE PUMP

[75] Inventors: Toshihiko Muramatsu, Chiryu; Motoya Ito, Hekinan; Atsushige Kobayashi, Nagoya, all of Japan

[73] Assignee: Denso Corporation, Kariya, Japan

[21] Appl. No.: 781,816

[22] Filed: Jan. 9, 1997

[30] Foreign Application Priority Data

Jan. 11, 1996 [JP] Japan ..... 8-003119
Nov. 29, 1996 [JP] Japan ..... 8-319298

[51] Int. Cl.[6] ..... F04D 29/42

[52] U.S. Cl. ..... 415/55.1

[58] Field of Search ..... 415/55.1, 55.2, 415/55.3, 55.4, 55.5

[56] References Cited

U.S. PATENT DOCUMENTS 3,392,675 7/1968 Taylor ..... 415/55.4
4,591,311 5/1986 Matsuda et al. .
5,011,369 4/1991 Mine et al. .
5,498,124 3/1996 Ito et al. ..... 415/55.1

FOREIGN PATENT DOCUMENTS 55-32909 3/1980 Japan .
2-169892 6/1990 Japan .
3-18688 1/1991 Japan .
6-42490 2/1994 Japan .
6-288380 10/1994 Japan .
8-35498 2/1996 Japan .

*Primary Examiner*—John T. Kwon
*Attorney, Agent, or Firm*—Nixon & Vanderhye P.C.

[57] ABSTRACT

The present invention provides a regenerative pump for supplying fuel into an injection device for an internal combustion engine. The regenerative pump has a longer pressurizing passage and a slanted discharge port connected thereto and formed at an outer periphery thereof. The pressure loss in the pump is small because the fuel flows smoothly into the discharge port from the pressurizing passage, and accordingly the efficiency of the pump is high and the pump can be made small in size at the same time.

10 Claims, 13 Drawing Sheets

REGENERATIVE PUMP

CROSS-REFERENCE TO RELATED APPLICATIONS

The present application is based upon and claims the benefit of priority of Japanese Patent Applications No. Hei-8-3119 filed on Jan. 11, 1996 and No. Hei-8-319298 filed on Nov. 29, 1996, the contents of which are incorporated herein by reference.

BACKGROUND OF THE INVENTION

1. Field of the Invention

The present invention relates to a regenerative pump having an improved discharge port to improve efficiency of the regenerative pump, particularly, a fuel supply pump used in a fuel injection system for an internal combustion engine.

2. Description of Related Art

As shown in FIG. 11, Japanese Patent Laid-Open Publication No. Sho-60-79193 discloses a regenerative pump having a pump casing 1 and impeller 2 disposed in the casing 1. In casing 1, there is provided a C-shaped passage 3. The pump casing 1 is composed of casing 1*a* shown in FIG. 12 and casing cover 1*b* shown (inverted) in FIG. 13, both being overlapped on each other. On the casing 1*a*, a depressed portion serves as a impeller space 4. Around impeller space 4, is circular ditch 3*a* constituting the passage 3. On casing cover 1*b*, another circular ditch 3*b* provides part of passage 3. At an upstream end of circular ditch 3*b* is suction port 5. At a downstream end of circular ditch 3*a* is discharge port 6.

On the periphery of impeller 2, a plurality of alternating blades 2*a* and blade ditches 2*b* stick out in the passage. As the impeller rotates, fluid in blade ditches 2*b* is pushed out to passage 3 from blades 2*a*, and, subsequently the fluid that was pushed out to the passage 3 is again sucked into blade ditches 2*b* and pushed out again to passage 3. The fluid is regeneratively re-circulated in this manner and thereby pressurized in the course of its flow from the upstream end to the downstream end, and it is discharged from discharge port 6 as a pressurized fluid. A portion indicated by part number 7 in FIGS. 11 and 12 is a sealing wall.

A regenerative pump of this kind is often used as a fuel supply pump in a fuel injection device for an internal combustion engine, because it can produce a relatively high fuel pressure for a low viscosity fluid.

In a conventional regenerative pump, discharge port 6 is provided at the downstream end of passage 3, stretching perpendicularly to passage 3, i.e., in parallel to the impeller axis.

In the conventional regenerative pump described above, discharge port 6 is located at the same position as the downstream end of passage 3, and therefore the downstream end is occupied by discharge port 6. Accordingly, passage 3 is terminated at a position immediately before discharge port 6, resulting in shortening of the effective length of passage 3 and in decreasing the pressurizing effect achieved by each rotation of impeller 2. To compensate for this negative effect, it is conceivable that one might increase the rotational speed of impeller 2. However, if the rotational speed were increased, friction loss between the impeller shaft and a bearing supporting the impeller and other losses would be increased, and accordingly pump efficiency would be decreased.

In addition, since discharge port 6 is perpendicular to passage 3, pressurized liquid fuel flowing through passage 3 hits wall 6*a* at the downstream end of passage 3 as shown an arrow "A" in FIG. 14. The liquid fuel therefore has to change its flow direction by approximately 90-degrees at discharge port 6, and this results in a large loss also decreasing pump efficiency.

To decrease losses resulting from changing flow direction, a pump discharge port having a slope 8 as shown in FIG. 14 has been proposed. However, when slope 8 is formed at the downstream end of the passage, the effective length of the passage is decreased.

In Japanese Patent Laid-Open Publication No. Hei-1-177492, the multi-stage regenerative pump shown in FIG. 15 is disclosed. In this pump discharge port 6 is formed at the downstream end which is made at a position stretched tangentially from a mid portion of the passage 3. The purpose of this design is to reduce liquid fuel velocity when it is forced to change directions. However, the passage portion made for leading fuel to discharge port 6 can not be utilized for pressurizing the fuel, and accordingly the effective length of passage 3 is still shortened. Moreover, since discharge port 6 in this disclosure is also bent by about 90-degrees from passage 3, it also decrease pump efficiency. In addition, the pump disclosed in this publication, becomes large in size because the leading passage is extended tangentially from the mid portion of passage 3 and it goes outside beyond the outer periphery of passage 3.

SUMMARY OF THE INVENTION

The present invention has been made in view of the above-mentioned problems, and an object of the present invention is to provide a regenerative pump in which the effective length of the pressurizing passage is made long enough to sufficiently pressurize the fluid while the losses resulting from flow direction change at the discharge port are minimized.

Another object of the present invention is to provide a regenerative pump having a smaller size by utilizing the housing space more effectively while keeping sufficient sealing wall length.

According to the present invention, the discharge port is provided outside the passage in order to make the pressurization passage in which the fluid is pressurized longer. Fluid can flow smoothly from the downstream end of the passage to the discharge port because it has a centrifugal flow speed element in its flow pressurized by the friction force of the impeller blades. Moreover, since space in a radial direction of the sealing wall is utilized effectively, the size of the pump can be small. The loss occurring when fluid enters into the discharge port from the passage is deceased while keeping the sealing wall length long enough to prevent fluid leakage from the downstream end to the upstream end.

The discharge port is disposed with a slant angle so that the angle of flow direction change required at the final discharge port is kept small. Therefore, fluid flow from the passage to the discharge port is smoother.

A guiding portion for guiding pressurized fluid is also provided, according to the present invention, at the entrance to the discharge port (not in the passage). Therefore, fluid can flow more smoothly from the pressurizing passage to the discharge port.

Moreover, a separating wall is provided in each blade ditch of the impeller according to the present invention, and, therefore, a small space for the blade ditch can be utilized more effectively for pressurizing fluid.

Other objects and features of the present invention will become readily apparent from a better understanding of the preferred embodiment described below with reference to the following drawings.

DETAILED DESCRIPTION OF THE PREFERRED EMBODIMENT

Figure 9:
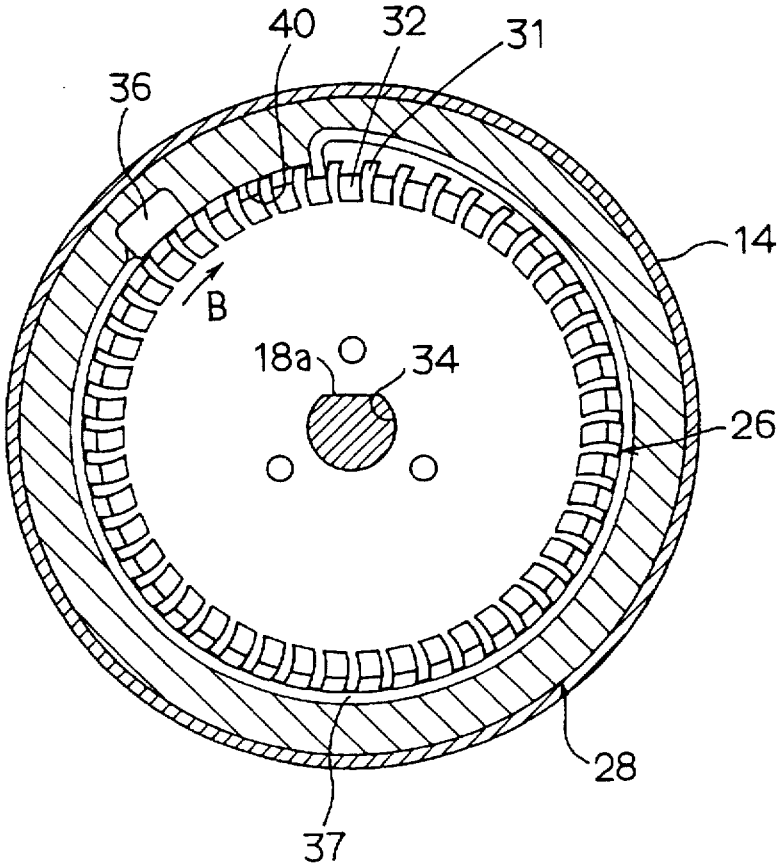
FIG. 9 is a cross-sectional view showing a pump of the embodiment.
Figure 10:
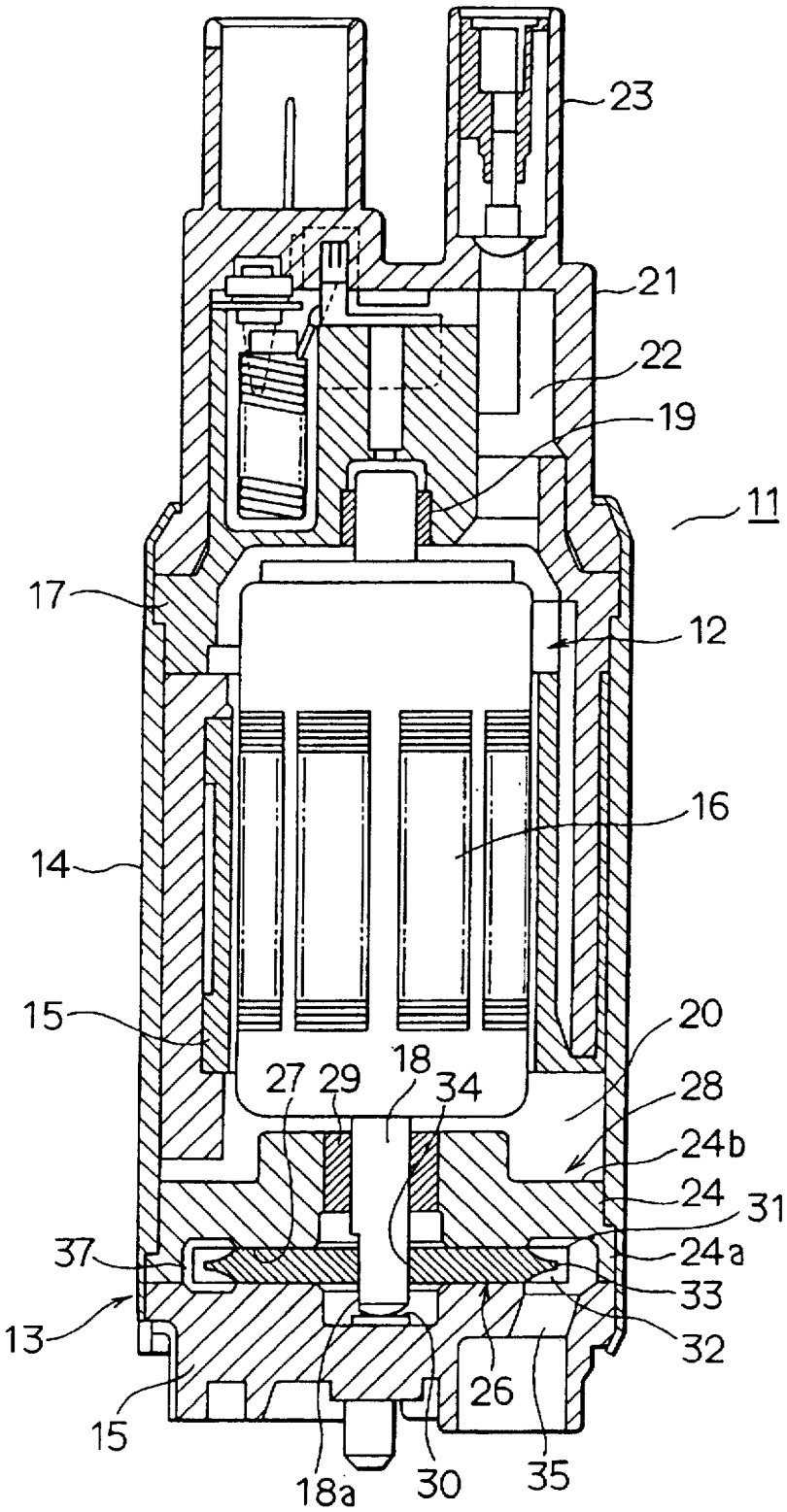
FIG. 10 is a cross-sectional view showing a fuel pump assembly according to the present invention.

An embodiment according to the present invention will be explained, referring to FIGS. 1 through 10. A regenerative fuel pump 11 shown in FIG. 10 is dipped in a fuel tank of an automotive vehicle. As shown in FIG. 10, fuel pump 11 includes motor 12 and pump 13 both of which are contained in a housing 14.

The motor 12 is a direct current motor having brushes therewith, and includes a permanent magnet 15 contained in housing 14 and an armature 16 disposed inside permanent magnet 15. At one end of the housing a bearing holder 17 is fixed and a radial bearing 19 for supporting one end of the armature shaft 18 is disposed in bearing holder 17. On top of bearing holder 17 a cover end support 21 is crimped with the housing 14. The inside of housing 14 also serves as a chamber 20 for sending fuel discharged from pump 13 to an injection device for an internal combustion engine. An outlet pipe 23 communicating with the chamber 20 is provided on the cover end support 21 via a ditch 22. A tube (not shown in the drawing) is inserted into outlet tube 23, and pressurized fuel discharged from pump 13 into the chamber 20 is supplied to an injection device for an internal combustion engine.

The pump 13 is a regenerative pump, and includes casing 24 having radial wall 24*a* and side wall 24*b* closing one end of radial wall 24*a*, both of which are formed in a single body, casing cover 25 closing the other end of radial wall 24*a*, and impeller 26. The casing 24 is inserted into the other end of housing 14, and casing cover 25 is mounted on casing 24 and crimped with the other end of housing 14. A pump casing 28 includes casing 24 and casing cover 25, forming an impeller space 27 therein. The casing 24 and casing cover 25 are made of aluminum by die-casting in this embodiment, but they can be also made of plastic resin by molding.

The other end of the armature shaft 18 is inserted into pump casing 28, and supported by radial bearing 29 held by side wall 24*b* of casing 24 and thrust bearing 30 fixed on casing cover 25.

Figure 4:
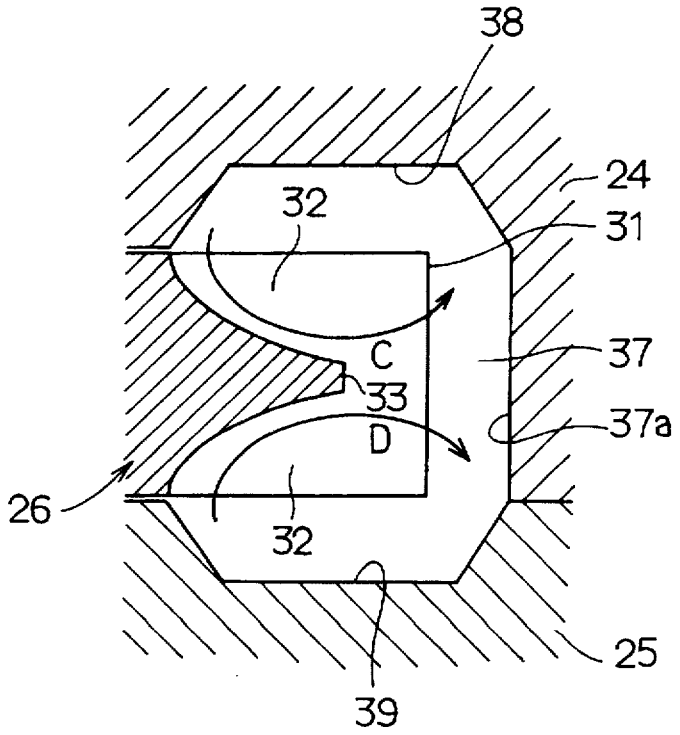
FIG. 4 is a partial cross-sectional view showing an impeller and a passage of the embodiment.

The impeller 26 is made of a phenol resin reinforced by glass fiber, PPS or the like, and has a disk shape. On the outer periphery of impeller 26, a plurality of blades 31 and blade ditches 32 shown in FIG. 4 is formed alternately along the periphery. The blade ditches are formed at both side of separating wall 33 as shown in FIG. 4. The impeller 26 is installed in impeller space 27, and a D-shaped cut 18*a* of the armature shaft 18 is slidably inserted into the D-shape hole 34 of impeller 26. Therefore, impeller 26 rotates according to rotation of armature shaft 18 and is slidable axially.

Figure 5:
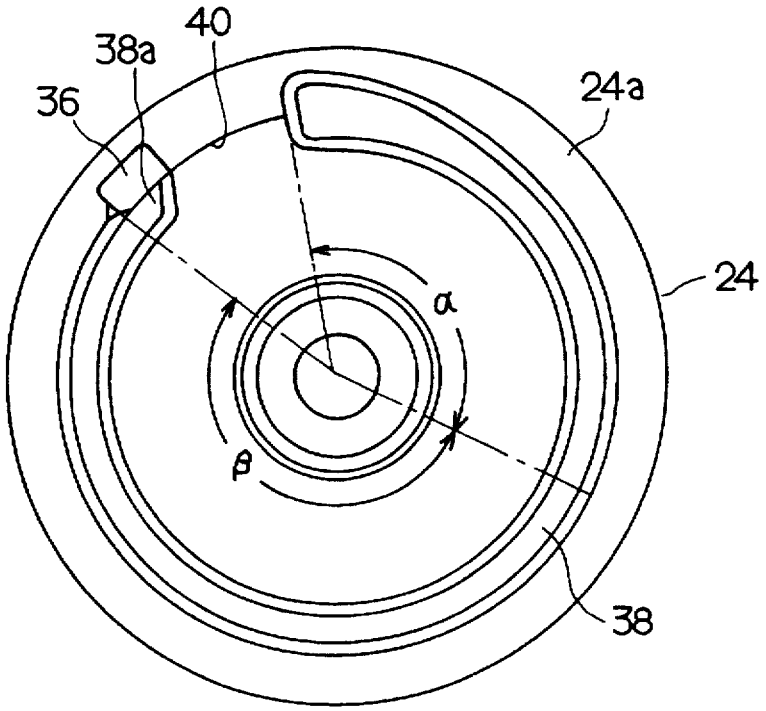
FIG. 5 is a plan view showing a casing of the embodiment.
Figure 6:
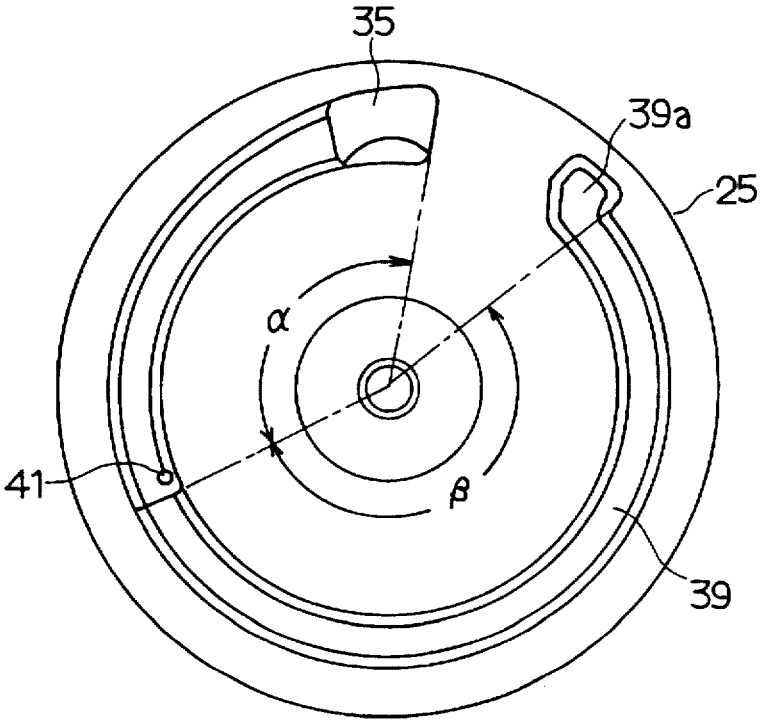
FIG. 6 is a plan view showing a casing cover of the embodiment.
Figure 7:
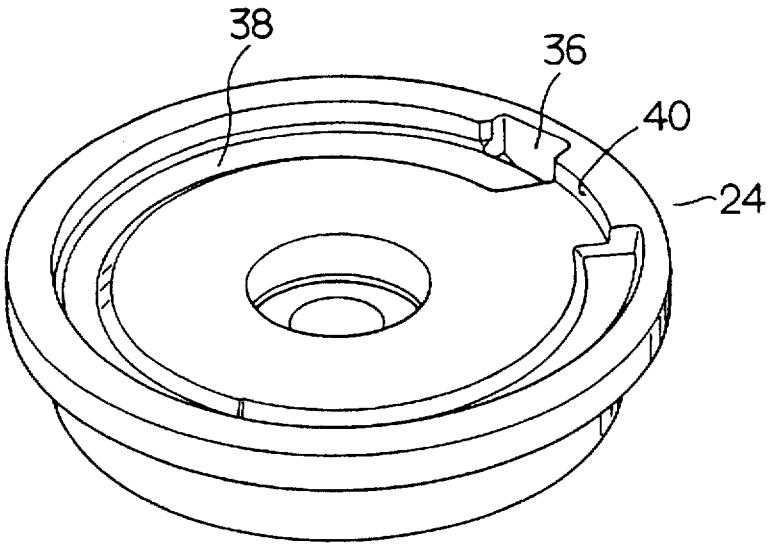
FIG. 7 is a perspective view showing a casing of the embodiment.
Figure 8:
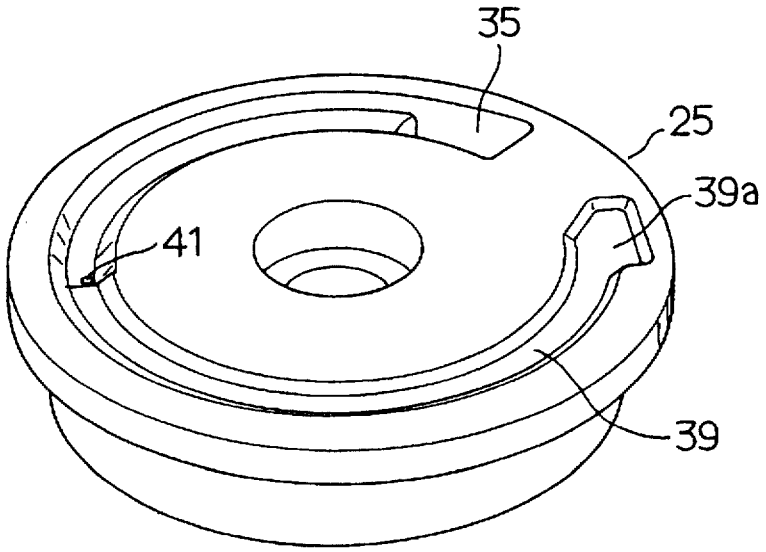
FIG. 8 is a perspective view showing a casing cover of the embodiment.

As shown in FIGS. 5 through 8, suction port 35 is formed on casing cover 25, and discharge port 36 is formed on side wall 24*b* of the casing 24 with a certain angle apart from suction port 35. As shown in FIG. 9, a C-shaped passage 37 connecting suction port 35 and discharge port 36 is formed circularly around impeller space 27 the pump casing 28. The blades 31 the impeller 26 are sticking out in passage 37. An end of passage 37 at suction port 35 is referred to as an upstream end hereafter and the other end of passage 37 at the discharge port as a downstream end. The downstream end of passage 37 includes of an end ditch 38*a* of casing 24 and an end ditch 39*a* of casing cover 25, as shown in FIGS. 5 and 6.

As shown in FIGS. 5 through 9, a radial space surrounding the impeller 26 is made by making a diameter of radial wall 24*a* of casing 24 larger than an outer diameter of impeller 26. An axial space at both sides of blades 31 is made by forming a C-shaped groove 38 on the side wall 24*b* of the casing 24 and another C-shaped groove 39 on the casing cover 25, respectively. A sealing wall 40 is formed on side wall 24*a* between both ends of C-shaped groove 38, so that the radial gap between the outer diameter of impeller 26 and sealing wall 40 becomes as small as possible in order to prevent leakage of pressurized fuel from discharge port 36 to suction port 35 through the radial gap. The longer circumferential sealing wall 40 becomes, the more perfect sealing is attained.

The suction port 35 is open at the upstream end of passage 37 and communicates with the fuel tank through casing cover 25. Fuel in the fuel tank is sucked into passage 37 of pump 13 according to rotation of impeller 26. The cross-sectional area of passage 37 is made so that it becomes gradually smaller from the upstream end toward the downstream end only for a certain angle "α" shown in FIG. 6. To change the cross-sectional area of passage 37 as mentioned above, the width and height of both C-shaped grooves 38 and 39 are changed. This means that the cross-sectional area of passage 37 is relatively large at its upstream end. This prevents the fuel passage from being abruptly narrowed in the neighborhood of suction port 35, thereby preventing cavitation of fuel. A small hole 41 for discharging fuel vapor to the fuel tank is formed at the upstream side of C-shaped groove 39 of casing cover 25.

The passage 37 is composed of two portions, that is, one is the portion with an angle "α" indicated in FIGS. 5 and 6 where the cross-sectional area is gradually decreasing as mentioned above, and the other is the portion with an angle "β" where the cross-sectional area is constant and the fluid is actually pressurized.

Figure 1:
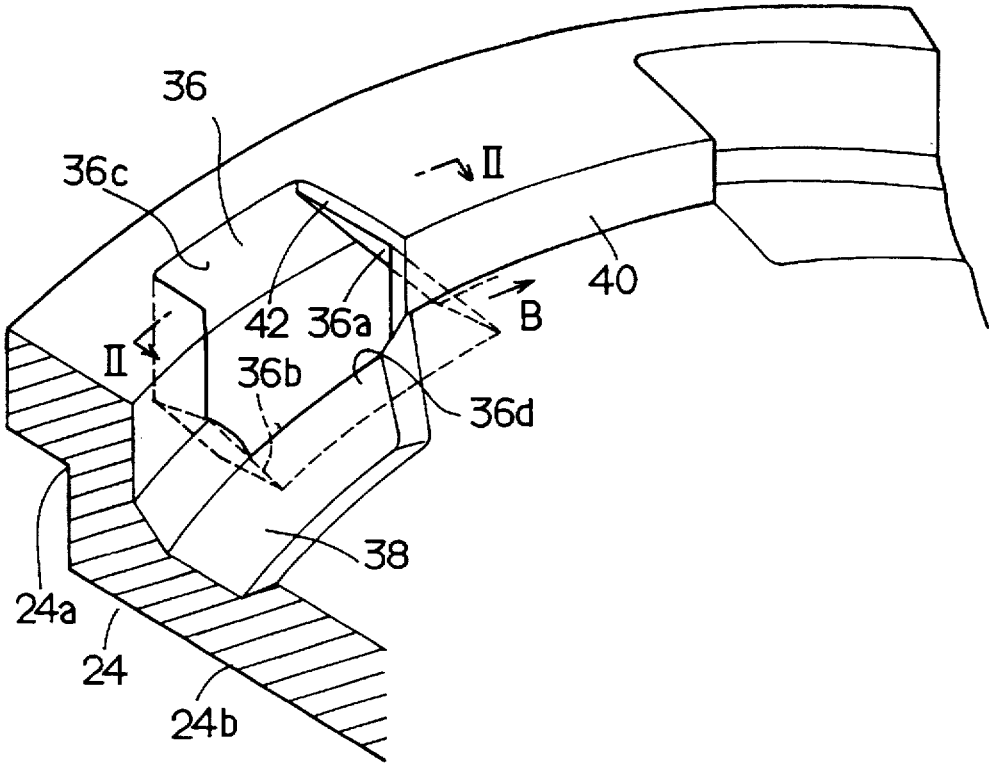
FIG. 1 is a perspective view showing an embodiment of the present invention.
Figure 3:
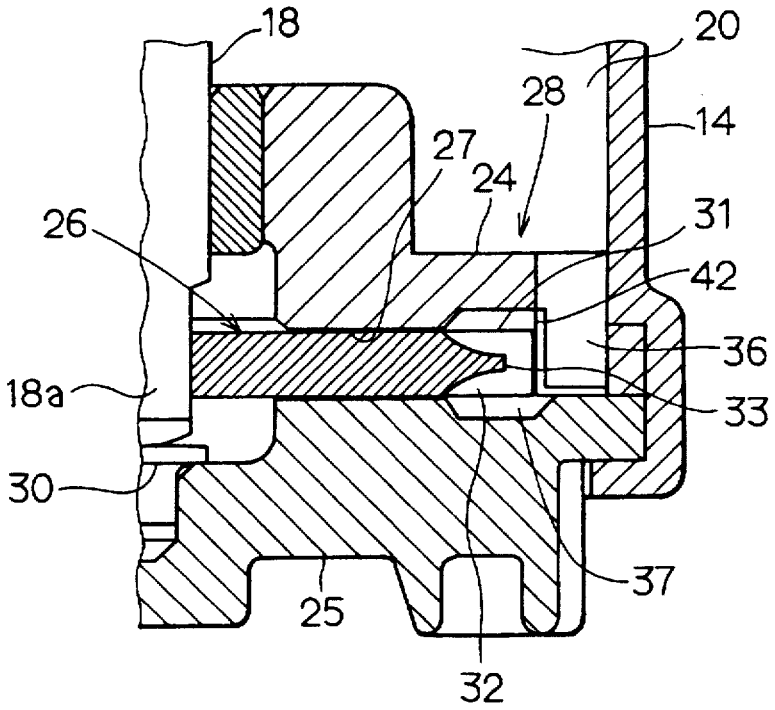
FIG. 3 is a cross-sectional view showing a pump according to the embodiment.

The discharge port 36, as shown in FIG. 1, is formed on radial wall 24*a* of casing 24 next to sealing wall 40, and is located outside in contact with passage 37. One end of discharge port 36 is open at the downstream end of passage 37 and the other end is open at chamber 20 in housing 14, passing through side wall 24*b* of casing 24, as shown in FIG. 3. The discharge port 36 has rectangular shape with its longer side made in the rotational direction of impeller 26. Liquid fuel pressurized according to rotation of impeller 26 is discharged from discharge port 36 to chamber 20. The down stream end of C-shaped groove 39 of casing cover 25 is widened to form a widened portion 39*a* which corresponds to discharge port 36, so that pressurized fuel can flow smoothly to discharge port 36 through widened portion 39*a*.

Figure 2:
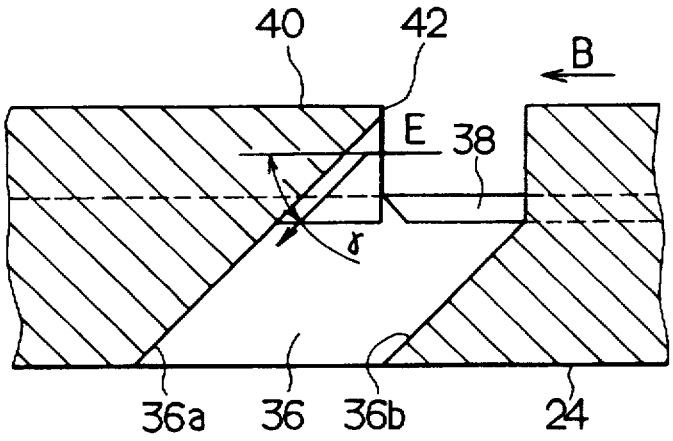
FIG. 2 is a cross-sectional view taken along a line II—II of FIG. 1.

As shown in FIG. 2, discharge port 36 is formed with a slant angle. That is, the discharge port is slanted from the passage 37 side toward the chamber 20 side, so that fuel flowing in direction "B" shown in FIG. 2 can smoothly enter into discharge port 36. As shown in FIG. 1, the slanted portion of discharge port 36 is formed under sealing wall 40, leaving narrow side wall 42 at one side of sealing wall 40. Therefore, discharge port 36 has two slanted surfaces 36*a* and 36*b* as shown in FIGS. 1 and 2. The slanted surface 36*a* stretches from the narrow side wall 42.

Now, operation of the regenerative fuel pump according to the present invention will be explained. The impeller 26 is driven by armature shaft 18 of motor 12. As impeller 26 rotates, pump 13 sucks liquid fuel in the tank into passage 37 through suction port 35. The fuel sucked into passage 37 flows from the upstream end of passage 37 toward the downstream end of passage 37. In the course of the flow, fuel flows in the blade ditches 32 as shown by arrows "C" and "D" in FIG. 4 by a friction force received from blades 31, and is send out to passage 37. The fuel in passage 37 is again sucked into the blade ditches 32. Thus, fuel circulates between blade ditches 32 and passage 37. In other words, fuel flows along walls of separating wall 33 in the blade ditches and then hits side wall 37*a* of fuel passage 37 and changes its flow direction there, and flows out into passage 37 and again is sucked into the blade ditches 32. The fuel, thus circulating in blade ditches 32 and passage 37, proceeds helically from the upstream end to the downstream end of passage 37. The flow speed of the fuel is decreased when fuel sent from the blade ditches 32 to passage 37 merges with fuel flowing in passage 37, and kinetic energy given to the fuel by blades 31 is converted to fluid pressure. Accordingly, the pressure of fuel flowing in passage 37 increases.

The fuel is pressurized during the course of flowing in direction "B" shown in FIG. 9 through a pressurizing passage with angle "β" shown in FIGS. 5 and 6, and flows into discharge port 36. Then, the pressurized fuel is discharged into chamber 20 in housing 14 and sent out to fuel injection device through a tube connected to the outlet pipe 23.

In the exemplary embodiment the pressurizing passage of passage 37 can be longer because discharge port 36 is disposed outside the passage as opposed to a conventional pump in which the discharge port is disposed at the end of the passage. Therefore, fuel can be pressurized to a higher pressure. In other words, since the fluid is pressurized in the regenerative pump as it circulates between blade ditches and the pressurizing passage during the course of flowing through the pressuring passage, the longer the pressuring passage becomes, the higher the fuel pressure that can be obtained.

Figure 11:
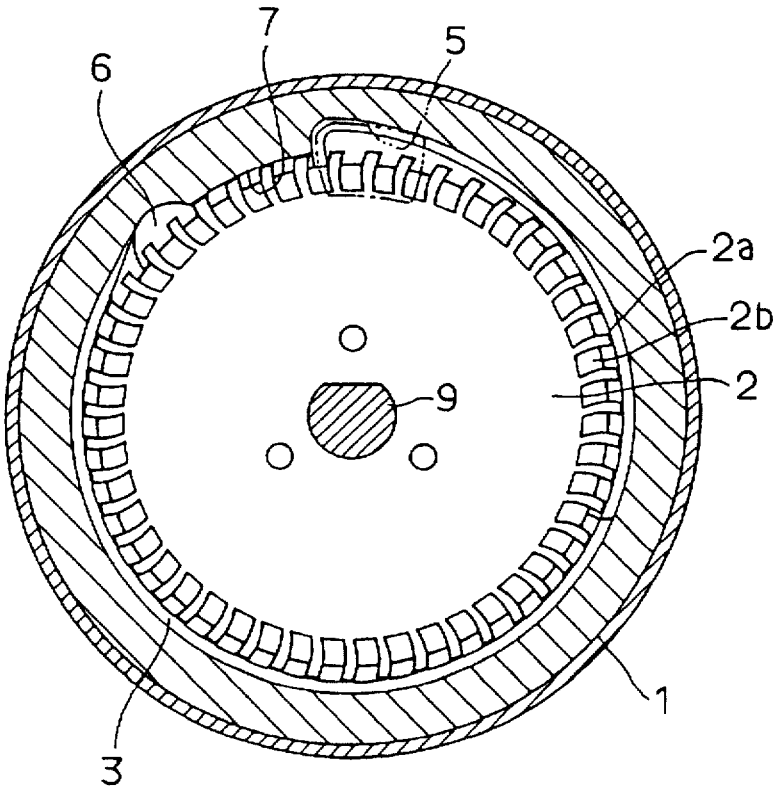
FIG. 11 PRIOR ART
FIG. 11 is a cross-sectional view showing a conventional regenerative pump.
Figure 12:
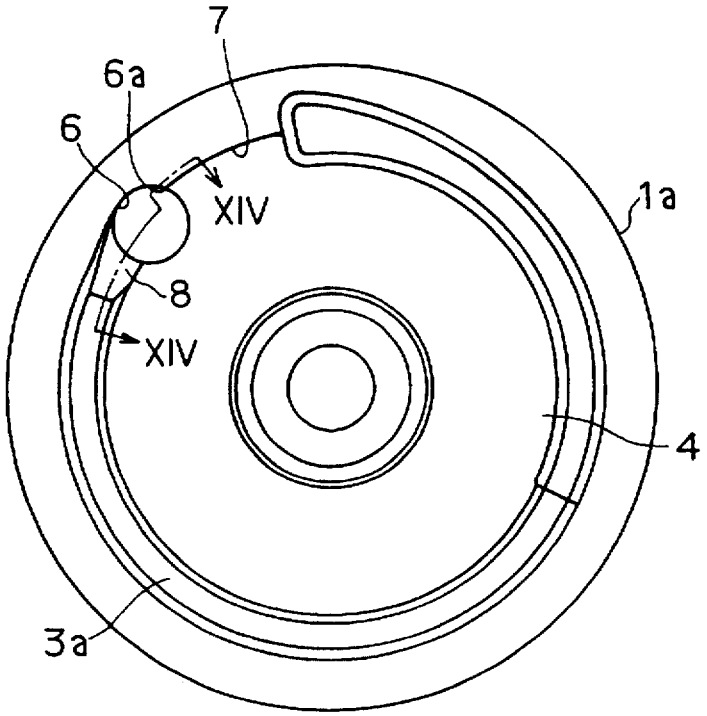
FIG. 12 PRIOR ART
FIG. 12 is a plan view showing a casing of a conventional regenerative pump.
Figure 13:
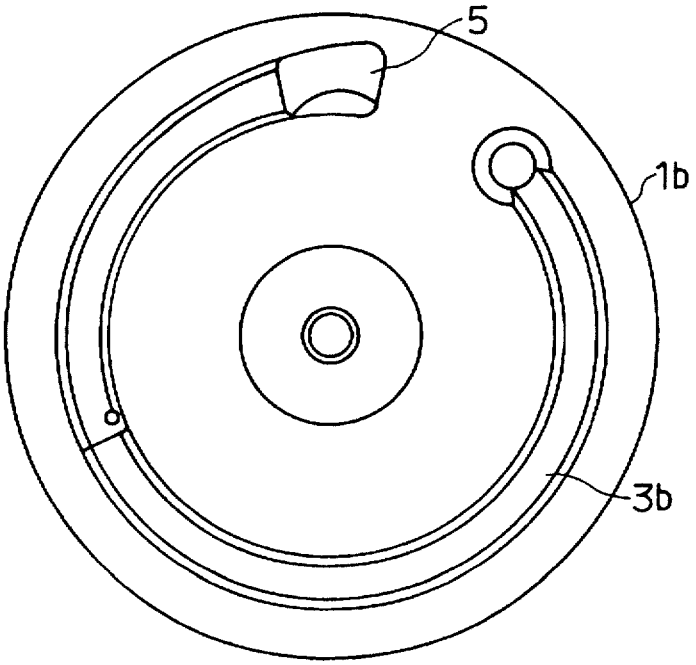
FIG. 13 PRIOR ART
FIG. 13 is a plan view showing a casing cover of a conventional regenerative pump.

In the conventional pump, there is provided a guide passage 8, as shown in FIGS. 11 and 12, for decreasing the fuel flow change of direction when the fuel enters into discharge port 6 from passage 3*a*. The guide passage 8 can not be utilized for pressuring fuel, and accordingly the pressurizing passage has to be shorter by the length of guide passage 8.

As opposed to this, according to the present invention, discharge port 36 is formed outside the passage 37 and a guide passage like passage 8 of the conventional pump is not necessary because discharge port 36 is formed with a slant angle as explained later. Therefore, the pressuring passage can be made longer according to the present invention, and the kinetic energy given to the fluid per one rotation of the impeller can be made larger. Accordingly, the fluid can be pressurized higher without increasing rotational speed of impeller 26. As mentioned above, the pressurizing passage is not the whole length of passage 37 but a length corresponding to angle "β". Therefore, saving the length of the guide passage has a relatively large effect in increasing fluid pressure in the pump. In addition, a guiding portion which has substantially the same cross-sectional area as the pressurizing passage is formed at the end of the pressurizing passage, facing the discharge port. Therefore, pressurized fluid can flow smoothly into the discharge port.

According to the present invention, since discharge port 36 is formed outside passage 37 (not inside the passage) and fluid flowing through passage 37 has a radial velocity element due to centrifugal force, the pressure loss occurring when the fluid changes its flow direction in entering discharge port 36 is very small, and accordingly fluid is discharged into the chamber 20 without loosing its pressure. Moreover, since discharge port 36 is formed with a slant angle as shown in FIGS. 1 and 2, fluid flowing through passage 37 having a velocity element along the passage hits slanted wall 36*a* and changes its flow direction there. In other words, the fluid changes its flow direction on slanted wall 36*a* as shown by an arrow "E" in FIG. 2. The flow direction change is an angle "γ" which is less than 90-degrees, resulting in less pressure loss due to a changing flow direction. In this particular embodiment, the angle "γ" is made at 45-degrees. Though fluid entering into discharge port 36 also hits narrow side wall 42, pressure loss is small because the surface of narrow wall 42 is small.

In order to confirm the effects of the present invention, computer analyses have been made, the results of which will be explained below referring to FIGS. 16 through 19.

The analyses have been made using an equation of motion according to a rotating coordinate system, a centrifugal force and a Coriolis force being added to the equation as external forces. As boundary conditions, the amount of flow from the suction port is set at 140 liters per an hour, and rotational speed of the impeller is set at 7500 rpm.

Figure 14:
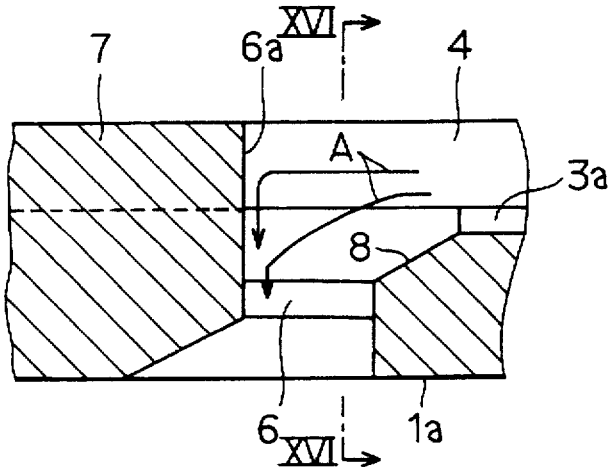
FIG. 14 PRIOR ART
FIG. 14 is a cross-sectional view taken along a line XIV—XIV of FIG. 12.
Figure 15:
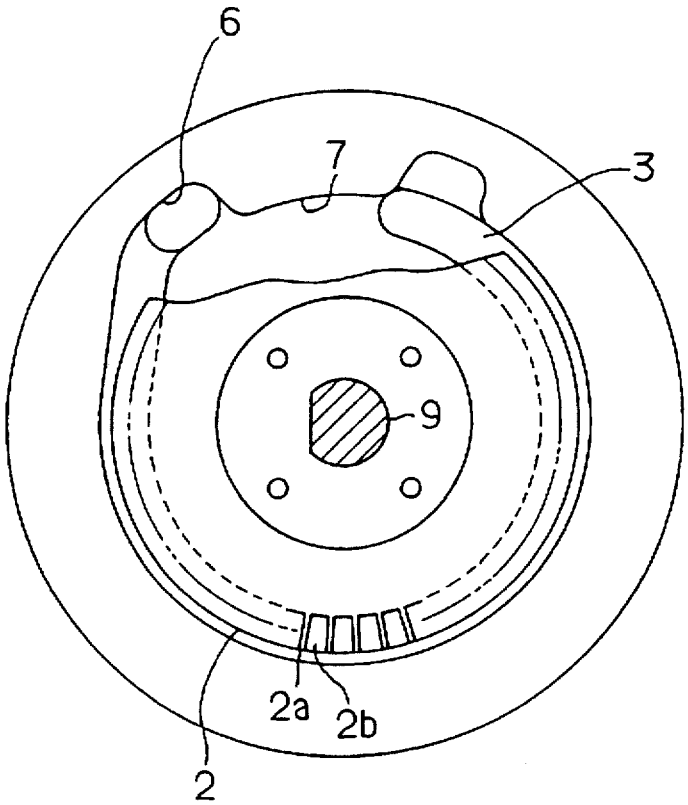
FIG. 15 PRIOR ART
FIG. 15 is a plan view showing another conventional regenerative pump, a part of casing cover being removed.
Figure 16:
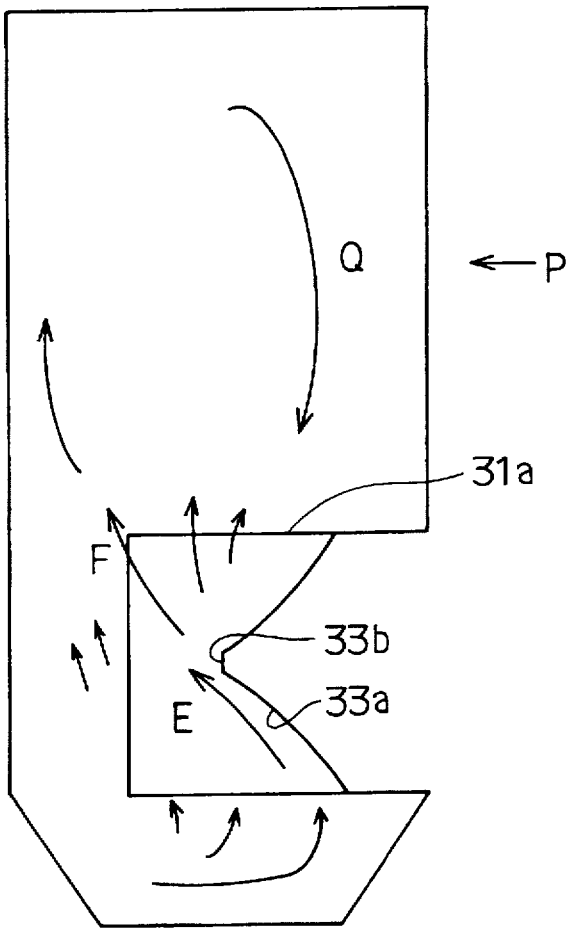
FIG. 16 is a flow analysis chart showing a cross-section taken along a line XVI—XVI of FIG. 14.

FIG. 16 shows a cross-sectional flow analysis chart along a line XVI—XVI of FIG. 14. Referring to FIG. 16, the following have become clear. Since the discharge port is disposed perpendicularly to the blade ditches, a strong flow "E" is formed along a separating wall 33*a*. A flow "F" having a velocity element in a rotational direction of the impeller and a velocity element in an axial direction of the impeller is formed from a neighborhood of the top surface 33*b* of the separating wall. The flow "F" is more intense at an outer wall side of the discharge port than at an inner wall side. Flow stagnation occurs at the inner wall side. In other words, only a part of the cross-sectional area of the discharge port is effectively used. Moreover, some backward flows "Q" are also observed. Accordingly, a large amount of pressure loss occurs. Further, the flow along separating wall 33*a* is not uniform because the flow "E" is too strong, which also causes a pressure loss.

Figure 17:
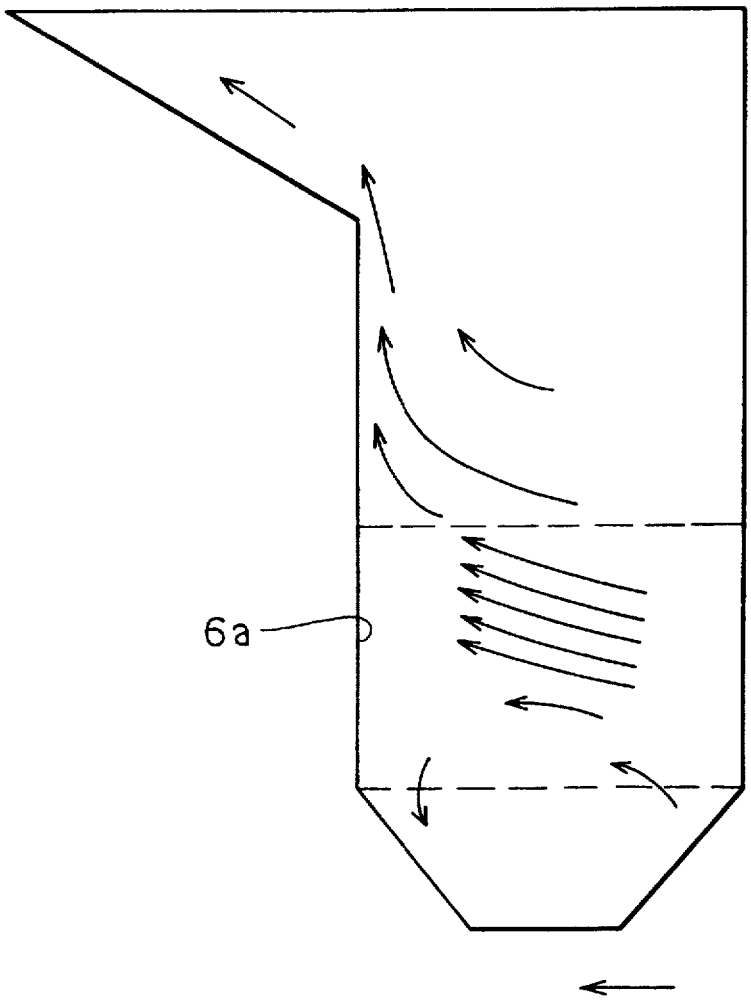
FIG. 17 is another flow analysis chart for the pump shown in FIG. 14.

FIG. 17 shows another cross-sectional flow analysis chart for the pump shown in FIG. 14. The following have become clear from this chart. The fluid flowing from the blade ditches flows in the rotational direction and hits an inner surface 6*a* of sealing wall 7, and changes the flow direction by 90-degrees there. Therefore, pressure loss caused by the flow direction change is large.

Figure 18:
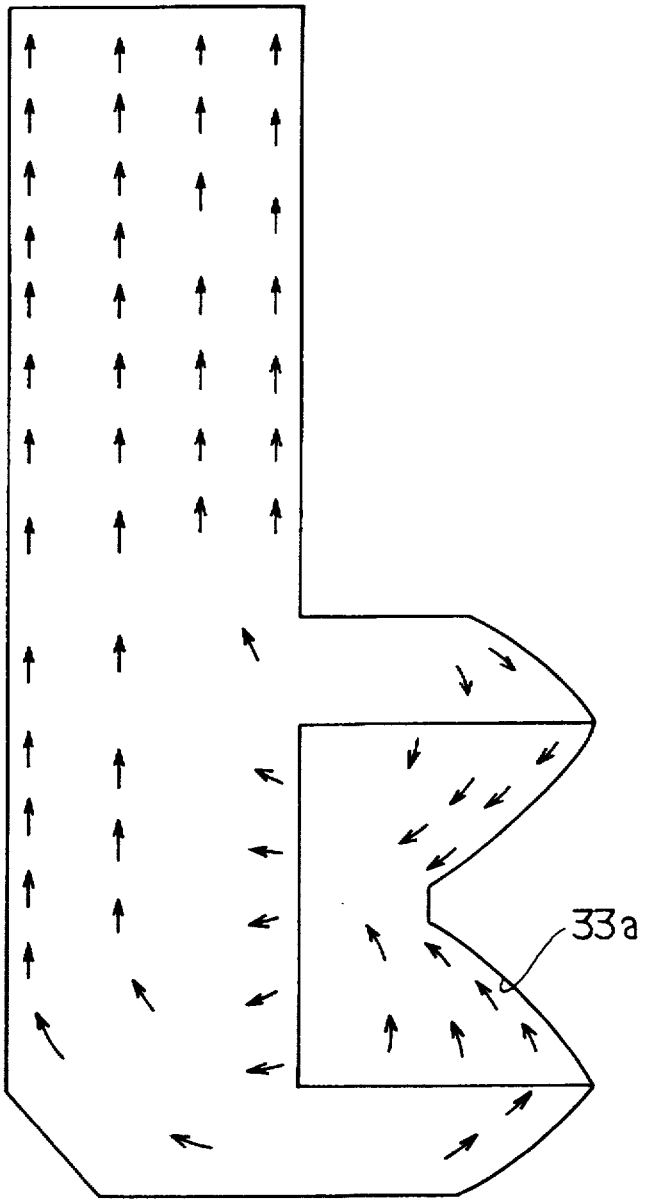
FIG. 18 is a flow analysis chart for the embodiment according to the present invention.

FIG. 18 shows a flow analysis chart for an embodiment according to the present invention having a discharge port disposed perpendicularly outside passage 37 thereto. Also, a guiding portion facing the discharge port and having the same cross-sectional area is formed at the downstream end of passage 37.

A flow along separating wall 33*a* is uniform because the strong flow "E" shown in FIG. 16 does not exist. The fluid proceeds helically along the four walls of discharge port 36 having a rectangular cross-section, and is discharged outside. Since flow along separating wall 33*a* is uniform, the discharge port is formed outside the passage in contact therewith with enough cross-sectional area, and the flow density in the discharge port is substantially uniform; fluid flow from the blade ditches of the impeller to the discharge port through the passage portion where flow direction is changed is smooth and therefore no substantial pressure loss occurs. In addition, no backward flow (which was observed in the conventional pump) exists. Accordingly, pump efficiency is increased in this exemplary embodiment.

Figure 19:
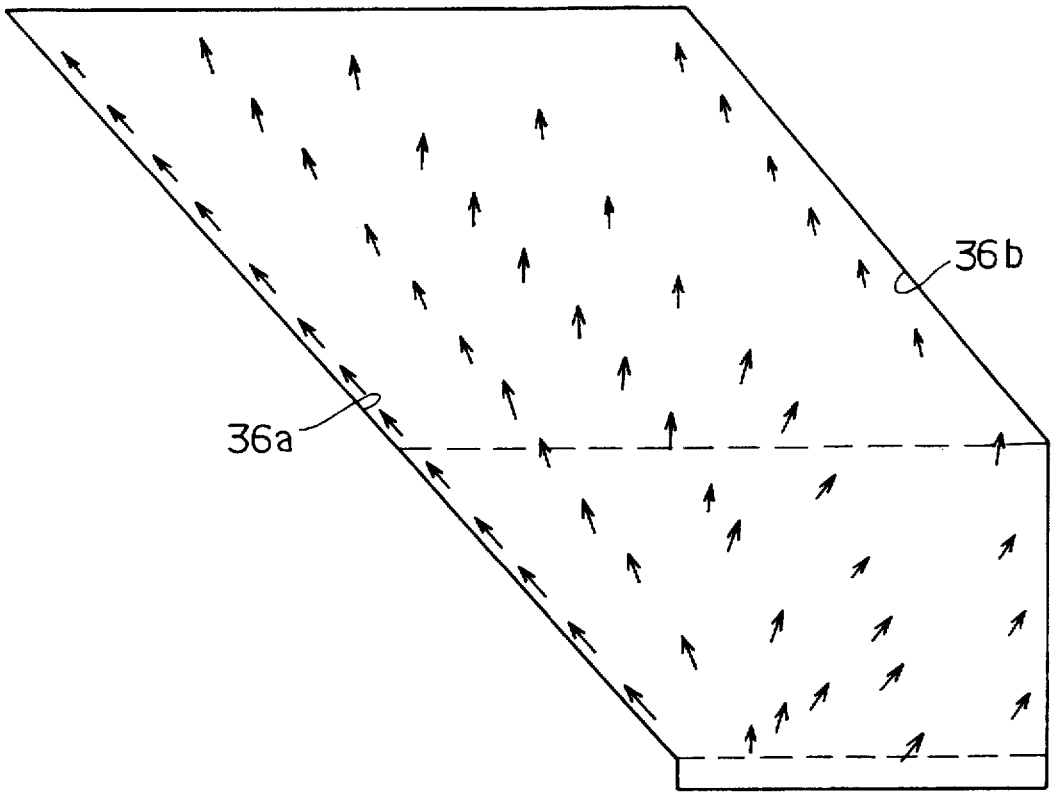
FIG. 19 is another flow analysis chart for the embodiment according to the present invention.

FIG. 19 shows another flow analysis chart for another exemplary embodiment having a discharge port disposed outside the passage 37 and formed with a slant angle as shown in FIGS. 1 and 2. The fluid flow coming from blade ditches 32 in the rotation direction hits the slanted wall 36*a* and changes its direction by the angle "γ" (shown in FIG. 2) on the slanted wall 36*a*. In this particular embodiment, angle "γ" is set at 45-degree. It is confirmed that fluid flows smoothly along slanted wall 36*a* and pressure loss caused by flow direction change is small. Accordingly, pump efficiency is improved.

Figure 20:
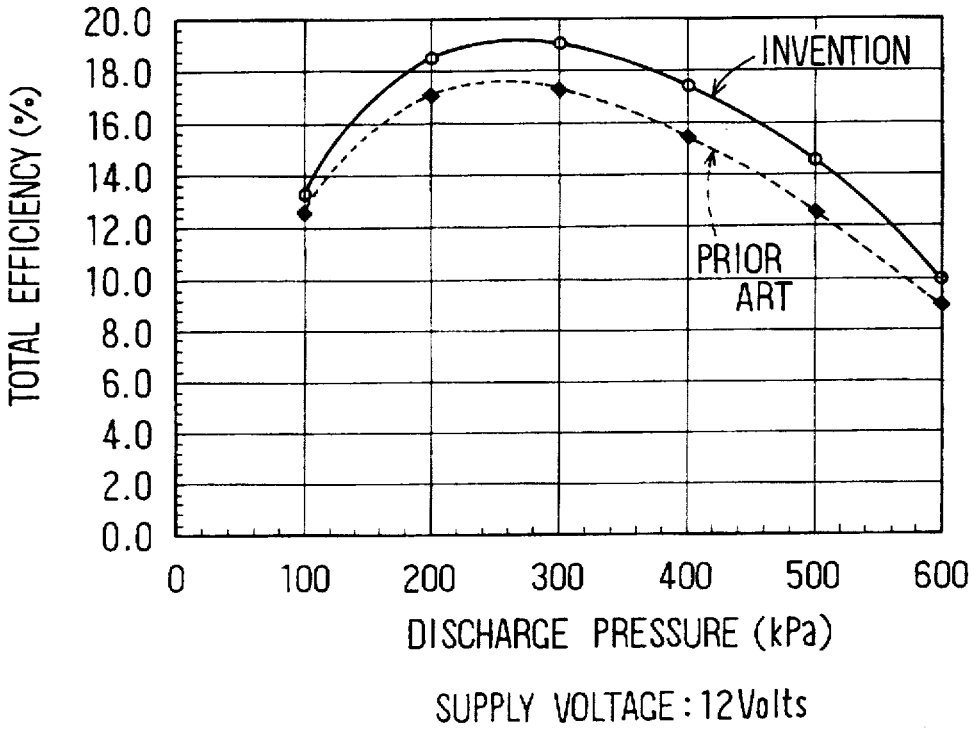
FIG. 20 is a graph showing a total efficiency of the regenerative pump according to the present invention in comparison with a conventional one.

FIG. 20 shows a total efficiency of the exemplary fuel pump in comparison with a conventional fuel pump. The efficiency is measured by changing discharge pressure from 100 kP to 600 kP at a constant supply voltage (12 Volts ) to the motor. The total efficiency a is defined here as PQ/VI, where P is a discharge pressure, Q is discharge quantity, V is supply voltage and I is current consumed.

As seen from the graph, the maximum total efficiency of the fuel pump according to the present invention is 19.2% and that of the conventional one is 17.6%. The efficiency has been increased by about 10%, resulting in decreasing the consumed current from 5.2 A to 4.7 A. Dimensions of the exemplary fuel pump used in measuring the total efficiency are: impeller diameter impeller is 30 mm, the slant angle "γ" of the discharge port is 45-degree, and the rectangular shape of the discharge port in the side wall 24*b* is 3.8 mm×2.0 mm (a long side along the rotational direction is 3.8 mm, and a short side in the radial direction is 2.0 mm).

The embodiment described above is a single stage pump having one impeller and passage. However, the present invention can be also applied to a multi-stage pump having plural sets of impellers and passages in which the fluid pressurized in one stage is sent to the next stage consecutively. Also, the present invention can be applied to a double-passage pump in which two concentric passages, i.e., an inner passage and an outer passage are formed, the discharge port of the inner passage is connected to the suction port of the outer passage, and two sets of blades and blade ditches are formed on the impeller, each set being disposed in each passage.

Further, the present invention is applied not only to the fuel pumps but also to other pumps for pressurizing fluid therein and discharge the pressurized fluid outside.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A regenerative pump for sucking, pressurizing and discharging fluid, said pump comprising:

a pump casing having at least one C-shaped passage including an upstream and a downstream end, a suction port communicating with the upstream end, a discharge port communicating with the downstream end and a sealing wall formed between the suction port and the discharge port for intercepting fluid flow therebetween;

an impeller disposed in the pump casing and having a plurality of blades and blade ditches alternately formed on an outer periphery thereof;

the discharge port being connected directly to the downstream end of the C-shaped passage at a radially outward position so that the discharge port is immediately adjacent and radially outside the sealing wall; and wherein fluid is sucked from the suction port, pressurized in the passage by circulating between the blade ditches and the passage, and discharged from the discharge port by rotation of the impeller.

2. A regenerative pump as in claim 1 wherein:

the discharge port is formed with a wall slant-angled away from a rotational plane of the impeller so that fluid flows out smoothly from the discharge port with its required change in flow direction being less than 90-degrees.

3. A regenerative pump as in claim 1 wherein the passage includes:

a guiding portion, for guiding fluid entering into the passage, having its upstream end connected to suction port and a cross-sectional area that decreases gradually toward its downstream end, and a pressurizing portion, for pressurizing the fluid therein, having its upstream end connected to the downstream end of the guiding portion, its downstream end connected to the discharge port and a cross-sectional area that is uniform throughout its entire length.

4. A regenerative pump as in claim 1, wherein:

the rotatable impeller includes separating wall formed in the blade ditch that projects radially outward in the ditch.

5. A regenerative fluid pump comprising:

a pump casing having at least one C-shaped passage between a suction port and a discharge port;

an impeller having a plurality of blades and blade ditches rotatable along and within said C-shaped passage;

a sealing wall disposed between ends of the C-shaped passage to substantially prevent fluid flow between the suction and discharge ports except via said C-shaped passage;

said C-shaped passage including a fluid pressurizing portion immediately upstream of said discharge port;

said discharge port being defined by a radially outward offset in the C-shaped passage at its most downstream end, a downstream circumferentially extending substantially flat wall of the discharge port being disposed at an incline behind the sealing wall which is immediately adjacent the discharge port;

wherein the discharge port is located directly and immediately between (a) the most downstream pressurizing portion of the C-shaped passage and (b) the sealing wall, such that regenerative fluid pressurization continues to increase fluid pressure without substantial interruption or transition until it reaches and passes radially outwardly through said discharge port.

6. A regenerative pump as in claim 5 wherein:

the flat inclined wall of the discharge port has a slant angle away from a plane of impeller rotation to make the required change in flow direction at an entrance to the discharge port smaller than 90-degrees.

7. A regenerative pump as in claim 5 wherein the flat inclined wall of the discharge port is, at one end, in direct contact with one end of the sealing wall.

8. A regenerative pump as in claim 5 wherein the discharge port is at a radially outer circumferential periphery of the passage.

9. A regenerative pump as in claim 8 wherein the entrance to said discharge port has substantially the same cross-sectional area as the cross-section of the pressuring passage portion.

10. A regenerative pump as in claim 5 wherein:

the impeller includes a separating wall formed in the blade ditch and projecting radially outwardly in the ditch.

* * * * *